US006968572B1

(12) United States Patent
Johnson et al.

(10) Patent No.: US 6,968,572 B1
(45) Date of Patent: Nov. 29, 2005

(54) FLUID BARRIER ARM CUFF

(75) Inventors: Michele L. Johnson, Boise, ID (US); Lyneve M. Zoellick, Kuna, ID (US)

(73) Assignee: Joz, Incorporated, Boise, ID (US)

( * ) Notice: Subject to any disclaimer, the term of this patent is extended or adjusted under 35 U.S.C. 154(b) by 59 days.

(21) Appl. No.: 10/161,892

(22) Filed: Jun. 3, 2002

Related U.S. Application Data

(60) Provisional application No. 60/306,514, filed on Jul. 18, 2001.

(51) Int. Cl.[7] ..... A41D 13/08
(52) U.S. Cl. ..... 2/16
(58) Field of Search ..... 2/60, 16, 20, 174, 2/DIG. 5, 124, 123, 162, 170; 15/227, 248.1, 15/248.2; 220/571, 661

(56) References Cited

U.S. PATENT DOCUMENTS

| | | | | | |
|---|---|---|---|---|---|
| 1,153,893 | A | * | 9/1915 | Conine | 2/170 |
| 1,302,038 | A | * | 4/1919 | Hayes | 2/59 |
| 1,407,658 | A | * | 2/1922 | Kelly | 2/170 |
| 1,534,208 | A | * | 4/1925 | Gibson | 239/288 |
| 1,808,049 | A | * | 6/1931 | Lyden | 2/170 |
| 2,473,740 | A | * | 6/1949 | Welch | 2/48 |
| 2,547,810 | A | * | 4/1951 | Burgess | 4/521 |
| 2,638,599 | A | * | 5/1953 | Flink | 2/170 |
| 2,686,916 | A | * | 8/1954 | De Grazia | 2/162 |
| 3,778,056 | A | * | 12/1973 | Witkowski | 273/444 |
| 3,883,897 | A | * | 5/1975 | Lefkowitz et al. | 2/161.6 |
| 4,399,567 | A | * | 8/1983 | Weon Joong | 2/161.6 |
| 4,453,271 | A | | 6/1984 | Donzis | |
| 4,464,260 | A | | 8/1984 | Duneau | |
| 4,947,868 | A | | 8/1990 | Schoolman | |
| 4,984,299 | A | * | 1/1991 | Halldorsdottir | 2/16 |
| 5,020,160 | A | | 6/1991 | Cano | |
| 5,070,540 | A | | 12/1991 | Bettcher et al. | |
| 5,375,262 | A | | 12/1994 | Carter | |
| 5,568,817 | A | | 10/1996 | Harty | |
| 5,682,613 | A | * | 11/1997 | Dinatale | 2/168 |
| 5,953,756 | A | | 9/1999 | Vrissimdjis | |
| 6,040,251 | A | | 3/2000 | Caldwell | |
| 6,049,905 | A | | 4/2000 | Owens | |
| 6,092,237 | A | * | 7/2000 | Baldwin | 2/161.7 |
| 6,249,917 | B1 | | 6/2001 | Vrissimdjis et al. | |

* cited by examiner

*Primary Examiner*—Katherine M Moran
(74) *Attorney, Agent, or Firm*—Christensen O'Connor Johnson Kindness PLLC

(57) ABSTRACT

The present invention is directed to a fluid barrier apparatus for an arm. In one broad aspect, the apparatus includes a seal portion defining an opening for the arm or any part thereof. The seal restricts passage of fluid between clothing or bare skin and the apparatus. The apparatus includes a basin which is connected to the seal. The basin collects any fluids running down the arm not passing through the seal or fluids which may occasionally fall on the basin. The apparatus further includes a lip portion adjacent to the basin which contains the fluids within the basin. Finally, the apparatus includes a drain for draining the accumulated fluids out of the basin. The drain can be a spout, drain holes, a cutout area in the lip, conduits, tubing, pipes, and the like.

13 Claims, 6 Drawing Sheets

FLUID BARRIER ARM CUFF

CROSS-REFERENCE TO RELATED APPLICATION

This application claims the benefit of provisional U.S. patent application No. 60/306,514, filed on Jul. 18, 2001.

FIELD OF THE INVENTION

The invention relates to a fluid barrier apparatus, specifically a fluid barrier apparatus designed to be worn on any part of the arm for reducing fluids running down the arm causing undesirable wetting.

BACKGROUND OF THE INVENTION

There are many activities that individuals perform on a regular basis which require one to have one's hand in a position where fluid, such as water or cleaning supplies, can flow from one's hand downward along the arm. An example of this would be any activity that requires one to work with one's hand above shoulder level. For example, washing windows, washing the siding of one's home, or washing recreational vehicles and the like, routinely require one to work with fluids above shoulder height.

One particular activity which routinely requires a hand position to be above the shoulder is washing horses and other livestock. Many horses are washed several times per day during competitions. The individual washing the horse must raise their arm above their shoulder to scrub the horse and will often scrub with one hand and rinse the horse with the other hand. The horse is generally rinsed with water supplied by a hose. Inevitably, the water from the hose runs down the individual's arm to other parts of the body, and drenches their clothing. This is an uncomfortable situation, often made more uncomfortable if the water is cold.

Horse owners have long sought ways to prevent this unwelcome drenching. Some individuals stand on a small stepstool or ladder, thus preventing them from needing to place their arm in a position which may lead to drenching. This is considered unsafe because in the event the horse becomes startled, it may move sideways into the stepstool or ladder and become entangled and injure itself or the individual washing the horse.

Therefore, there is a need for an apparatus that prevents the undesirable wetting of clothes during activities requiring one to have a hand position that results in fluids running down one's arm. The present invention fulfills such need and provides numerous advantages.

SUMMARY OF THE INVENTION

The present invention is directed to a fluid barrier apparatus for an arm. In one broad aspect, the apparatus includes a seal portion defining an opening for the arm or any part thereof. The seal restricts passage of fluid between clothing or bare skin and the apparatus. The apparatus includes a basin which is connected to the seal. The basin collects any fluids running down the arm not passing through the seal or fluids which may occasionally fall on the basin. The apparatus further includes a lip portion adjacent to the basin which contains the fluids within the basin. Finally, the apparatus includes a drain for draining the accumulated fluids out of the basin. The drain can be a spout, drain holes, a cutout area in the lip, conduits, tubing, pipes, and the like.

The present invention has numerous advantages. For instance, the present invention can be worn over the skin or over any garment to seal the space between the apparatus and the arm or clothing. The apparatus provides a suitable barrier against fluids traveling down the arm or clothing. The apparatus is not required to be attached to a glove or a mitt or any other garment. In this respect, the apparatus of the invention is an independent unit. The use of less material makes the invention a more economically attractive option than mitts or gloves. The present invention includes a drain at a specific location which can be directed to drain the fluids in any direction, which is particularly advantageous to avoid being drenched.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
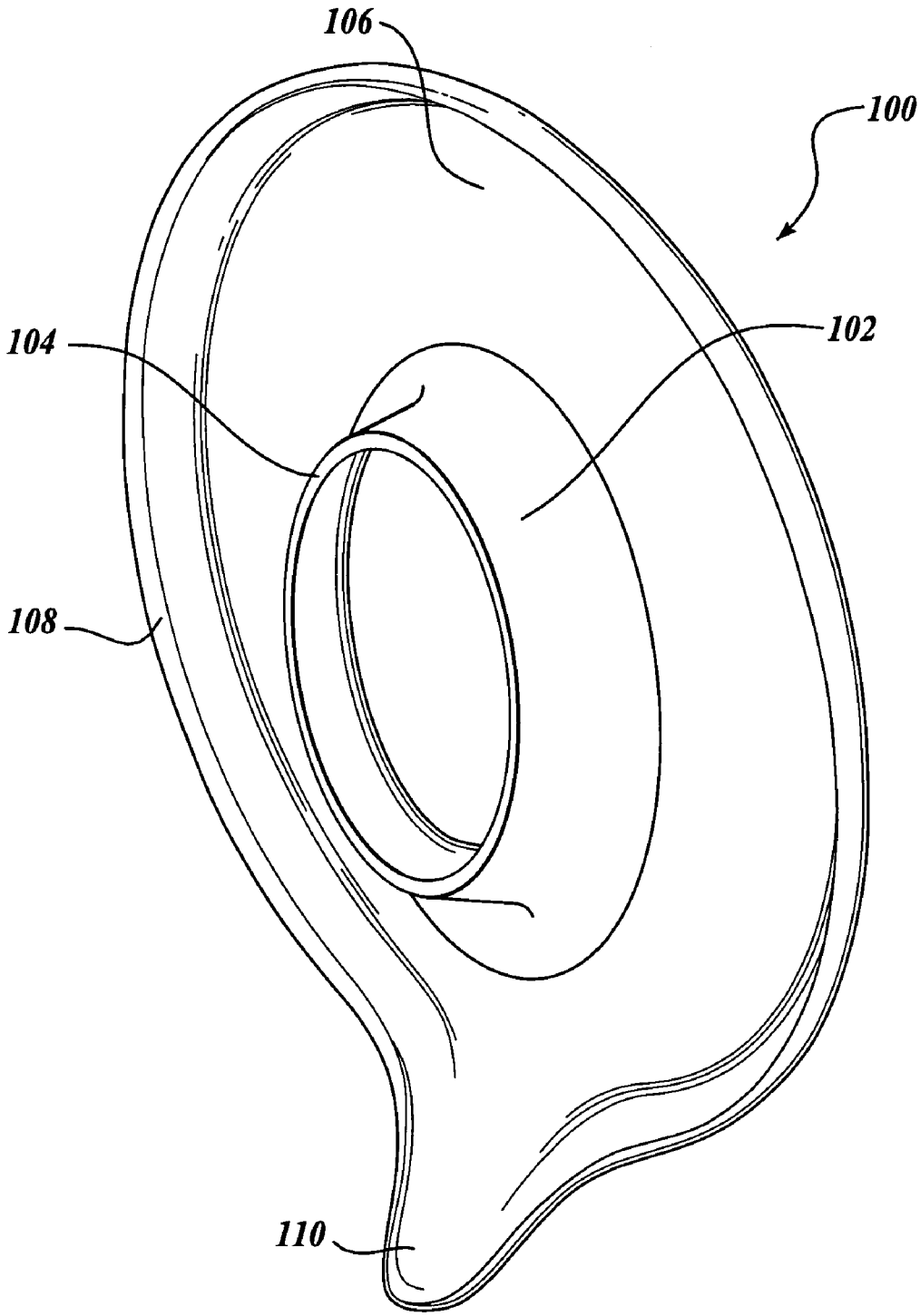
FIG. 1 is a perspective illustration of one embodiment of a fluid barrier apparatus according to the present invention.
Figure 2:
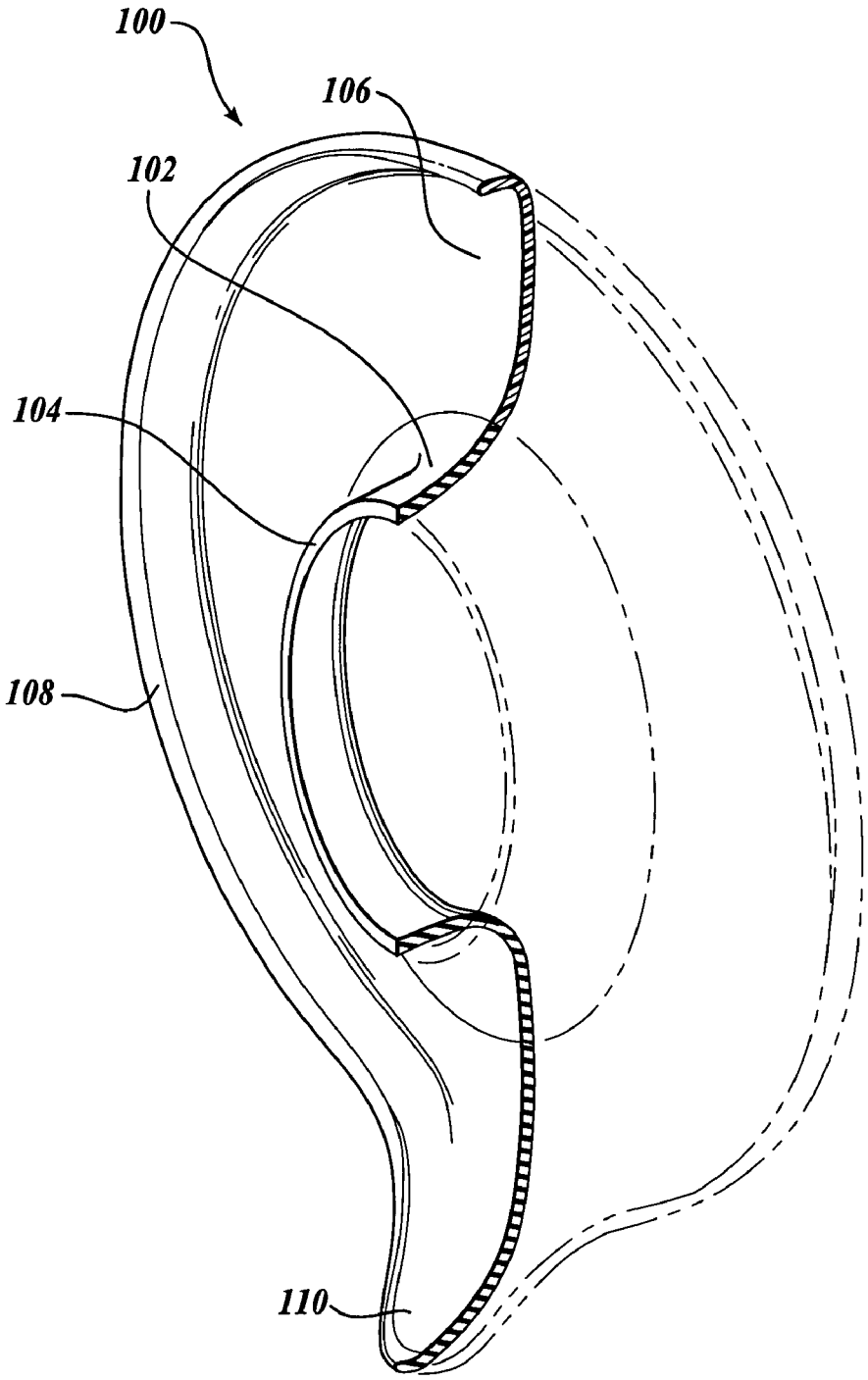
FIG. 2 is a cross-sectional illustration of the apparatus of FIG. 1 according to the present invention.

Referring collectively to FIGS. 1 and 2, one embodiment of a fluid barrier apparatus 100 for a wrist or any other part of the arm is illustrated. The fluid barrier apparatus 100 includes a seal 102 defining an opening 104 for the hand to pass therethrough. Eventually, when in use, the seal 102 may come to rest at or about the wrist area or at any other part of the arm. The seal 102 is connected to a basin 106. The basin 106 is adjacent to the seal 102. The fluid barrier apparatus 100 further includes a lip 108 surrounding the basin 106 at the basin periphery. The apparatus 100 includes a drain 110. In one instance, the drain 110 is formed out of an extension of both the basin 106 and the lip 108 to form a spout structure 110.

Generally the apparatus defines a circular outline when viewed from the axis passing through the center of the opening 104. However, it is to be appreciated that other shapes that are not generally circular are also within the scope of this invention. In one instance, the seal 102 includes a generally cylindrical walled structure having two ends. The first end forms the opening 104 which when slid onto the arm is positioned nearer the distal end of the arm (i.e., the hand). In one instance, the opening 104 is sized to fit snugly around an individual's wrist or any part of the arm thereof. The snug fit is beneficial for preventing the passing of fluids through the space between the skin and the seal 102. It should be understood that when clothing is worn on the arm, the seal 102 can also reduce passage of fluids in the space between the clothing and the apparatus. Any part of the interior surfaces of the cylindrical wall can lie adjacent or next to the skin at any part of the arm including the wrist.

The cylindrical wall of the seal 102 may be sloped beginning from the opening 104 and continue sloping until it connects to the basin 106 as seen more clearly in FIG. 2. In some instances, it may be difficult to delineate exact boundaries of the seal 102 and basin 106 or between the basin 106 and lip 108, particularly when the structures are made from similar materials.

In one embodiment, the seal 102 can be substantially flat (i.e., the slope is substantially zero or negative). In this second embodiment, as well as the embodiment described above, the opening of the seal 102 can be smaller than the intended part of the arm where it is to be worn to prevent the passage of fluids in the space between the skin and the seal. However, even in this instance, when the seal is placed on the arm, a cylindrical wall structure may be formed distally extending towards the hand due to the nature of the opening being smaller than the arm.

It should be readily apparent that the opening 104 can be made to any dimension so as to fit snugly about the intended user's arm, or any portion thereof, including the wrist.

It is also to be appreciated that the opening 104 need not be circular, but may be shaped in any manner, including a shape that is similar to a cross-sectional outline of a person's arm. In this manner, the opening more securely prevents seepage of any fluids between the seal and the arm.

At any distance beyond the opening 104 of the seal 102, the basin 106 can be connected thereto. The basin 106 functions, in one instance, to catch or collect any fluids that run from the hand downwards, do not pass under or through the seal 102 and are then directed onto the basin 106. The basin is the area of the apparatus 100 that lies between the seal 102 and the lip 108. The basin 106 extends radially outward from the seal 102 for any suitable distance in order to provide collection capabilities for the apparatus. It is to be appreciated that the greater the basin 106 extends from the seal 102, the greater the area of coverage afforded by the apparatus 100. A suitable size and collection capacity for the apparatus 100 can be easily determined and can be adjusted as deemed appropriate for the application. The basin 106 can have sloping areas where it joins with either the seal 102, the lip 108, or both as seen more clearly in FIG. 2. In one instance, the basin 106 can have a sloping area that is the lip 108. When the apparatus 100 is in use, the basin 106 is proximal in relation to the seal opening 104, i.e., meaning that the opening 104 lies nearer toward the hand than the basin 106; and the basin 106 lies nearer to the shoulder. The basin 106 can be cup-shaped so as to provide a depression with a lower-most point at or about the center of the basin 106. However, in other instances, the basin 106 can be substantially flat as seen in FIG. 2.

The apparatus 100 further includes a lip 108 surrounding the periphery of the basin 106. The lip 108 is a portion of the apparatus 100 that forms a container structure from the basin 106. The lip 108 is the outermost structure of the apparatus 100 relative to the opening 104. In one instance, the basin 106 and the lip 108 are integrally formed. However, it is readily appreciated that components such as the seal 102, the basin 106, the lip 108, or the spout 110, and any parts relating thereto, can be separate or integral in the apparatus of the present invention. The lip 108 can rise to any height above the basin 106. The lip 108 therefore extends away from the basin 106 in the same general direction as the cylindrical wall of the seal 102, as seen clearly in FIG. 2. In one particular embodiment, an extension is provided in the form of a spout 110 at the periphery of the basin 106 and lip 108.

Figure 6:
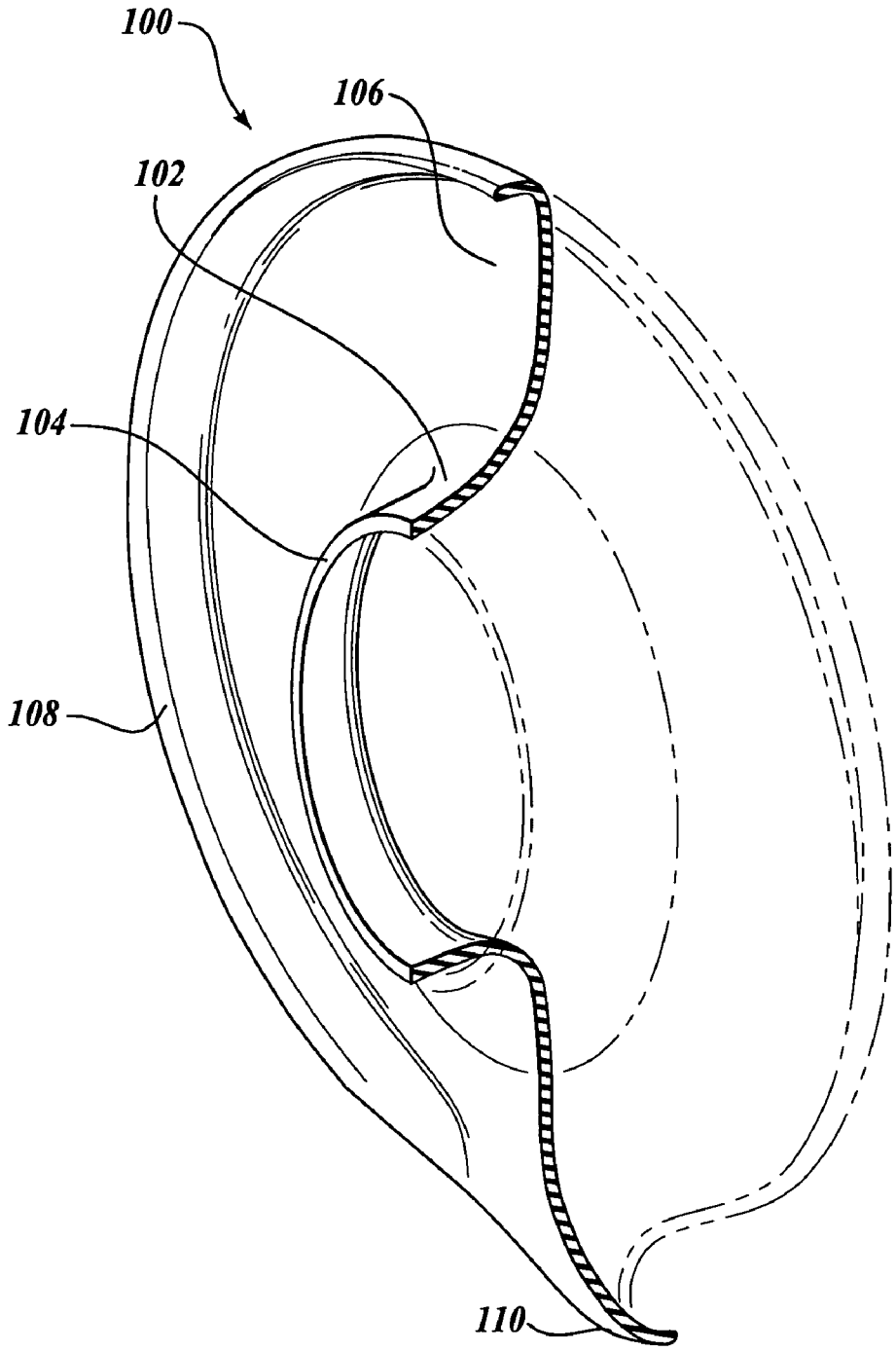
FIG. 6 is a cross-sectional illustration of one embodiment of an apparatus according to the present invention.

The spout 110 is formed out of the basin 106 and the lip 108, so as to provide an outlet drain from the basin 106. In use, spout 110 can be directed away from the user, so as to avoid being directly in the path of fluids leaving the drain 110. To this end, the spout 110 may have a lowered lip portion so as to be the location where the first overflow occurs upon filling of the basin 106. However, in other instances, the height of the lip 108 at the spout 110 can be substantially similar to the height of the lip at other parts of the basin 106. As shown in FIG. 2, the spout 110 can have a positive slope in relation to the basin 106. As shown in FIG. 6, the spout 110 can slope negatively in relation to the basin 106.

In one instance, the basin 106 gradually rises to meet up with the lip 108, thus forming the spout 110 as seen in FIG. 2. However, in other instances, the basin 106 can have a downward sloping area at the spout 110 with corresponding downward sloping lip areas as well, further encouraging the draining of fluids. It is to be appreciated that the apparatus 100 can have one or more spouts. Additionally or alternatively, drain holes may replace or supplement the spout 110. In yet another instance, the draining technique can employ a cutout or depressed area in the lip 108. Further embodiments of drains can include conduits, tubing, pipes, funnels, and the like.

Turning now to particular aspects of making the invention, the seal 102 can be made of any flexible material, including any material which is compatible with human skin. In some instances, the seal 102 can be made of elastomeric materials. For example, the seal 102 can be constructed out of latex, silicone, rubber, elastomeric polymers, and the like.

In one particular instance, the basin 106, the lip 108, and the spout 110, are constructed out of the same material, thus simplifying the manufacturing process. Such material can be the same or different than the material which forms the seal 102. If the seal material is different than the basin material, in many instances, it will be advantageous to make the basin 106 out of stiffer, more rigid material than the seal 102. For example, the basin 106, the lip 108, and the spout 110, can be constructed out of plastics. Suitable plastics for use in the present invention include those which are capable of being molded, injected, or are otherwise capable of being shaped into the structures of the basin 106, the lip 108, and the spout 110. Materials suitable for use in the present invention generally include impermeable or semi-permeable materials. However, even permeable materials can be used, such as textiles. Textiles may be provided with a coating of impermeable or semi-permeable materials or otherwise treated to impart an impermeable quality to them. In some instances, the plastics can be flexible or elastic. However, other materials capable of being molded, injected, or otherwise formed into the present apparatus are suitable. The various molding and fabrication techniques used to form the structures of the invention are well known, and thus the details of these processes are not detailed herein. One example, however, can utilize a latex compound which can be brushed or otherwise applied and shaped in conformance to a mold of the apparatus. When dried, the latex apparatus can be removed from the mold. In some instances, a mold may not be required.

If the materials utilized to form the seal 102 and the basin 106 are the same, the connection between the two can be substantially integral as both the seal 102 and the basin 106 can be formed in substantially one operation. However, if joining different materials, a boundary may exist delineating such materials as shown clearly in FIG. 2. The methods used to join two dissimilar materials such as the ones described above are well known, and thus, the details of these methods are not required to be explained. The lip 108 can be formed integrally with the basin 106 and, in some instances, the basin 106 can be considered to include the lip 108. However, in other instances, the lip 108 can be formed separately and attached, glued, or otherwise connected to the basin 106 so as to form a container structure for the retention of fluids within the confines of the basin 106 and the lip 108.

Figure 3:
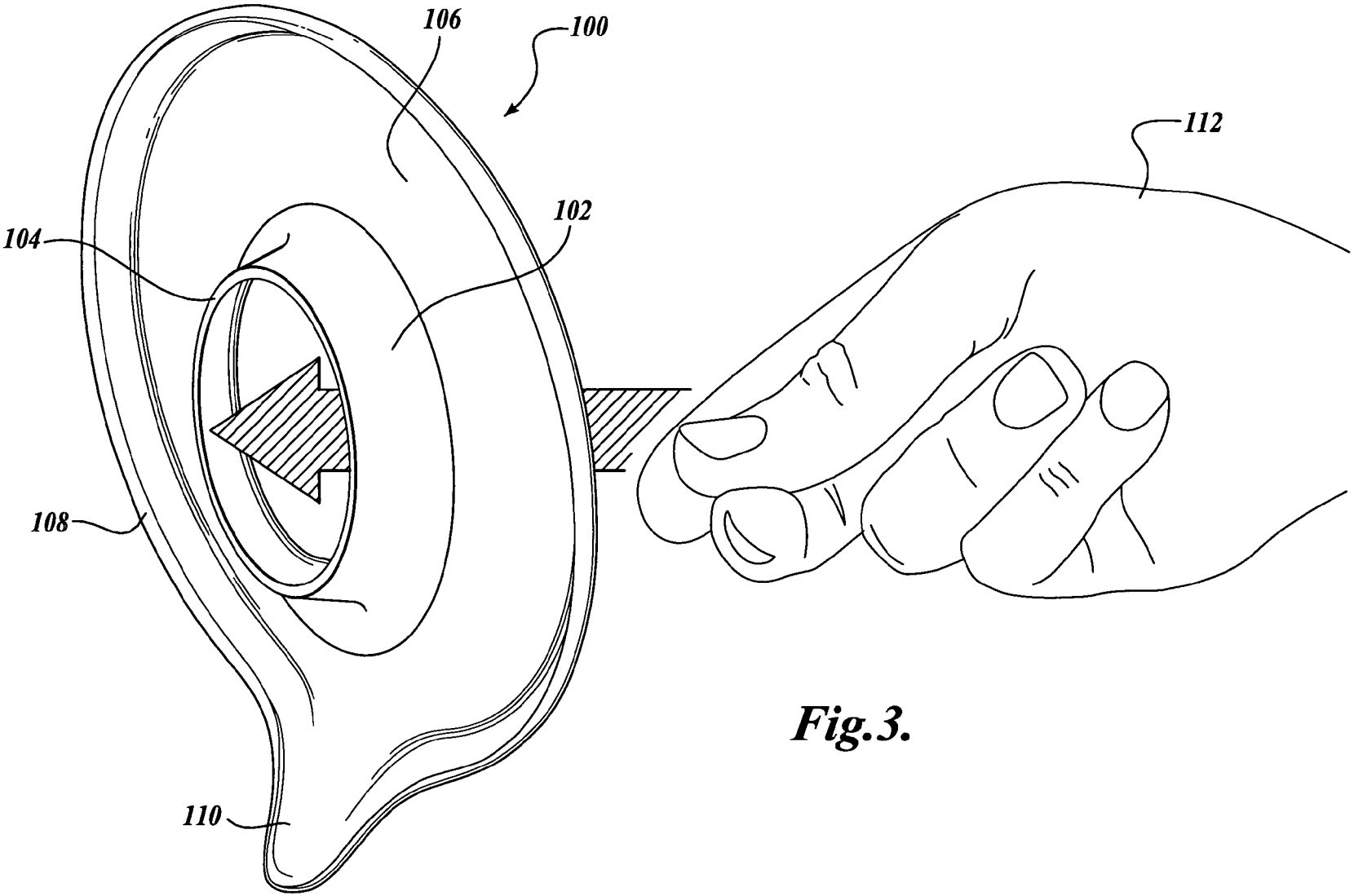
FIG. 3 is an illustration of how to use the apparatus of FIG. 1.
Figure 4:
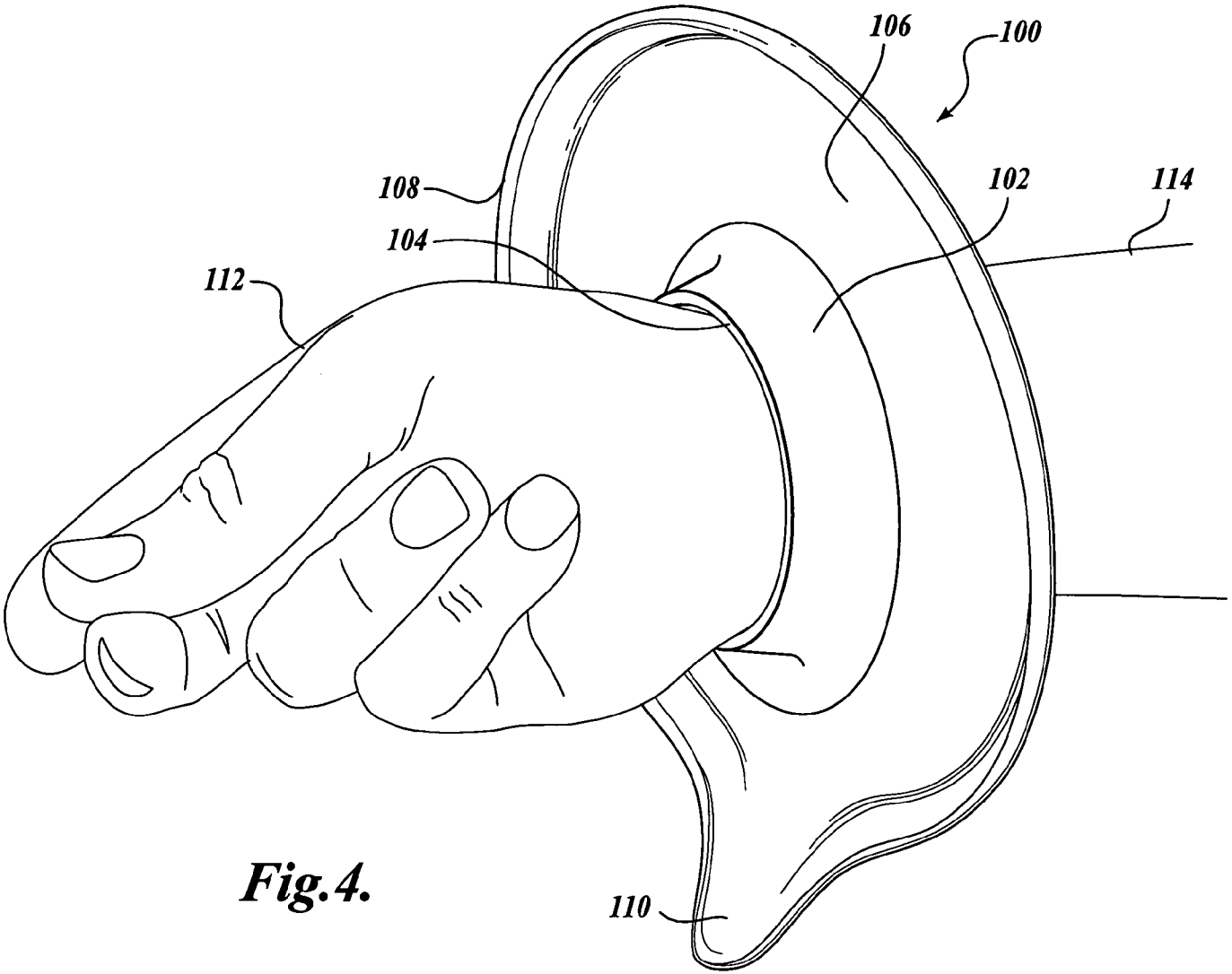
FIG. 4 shows the apparatus of FIG. 1 in place on the arm.
Figure 5:
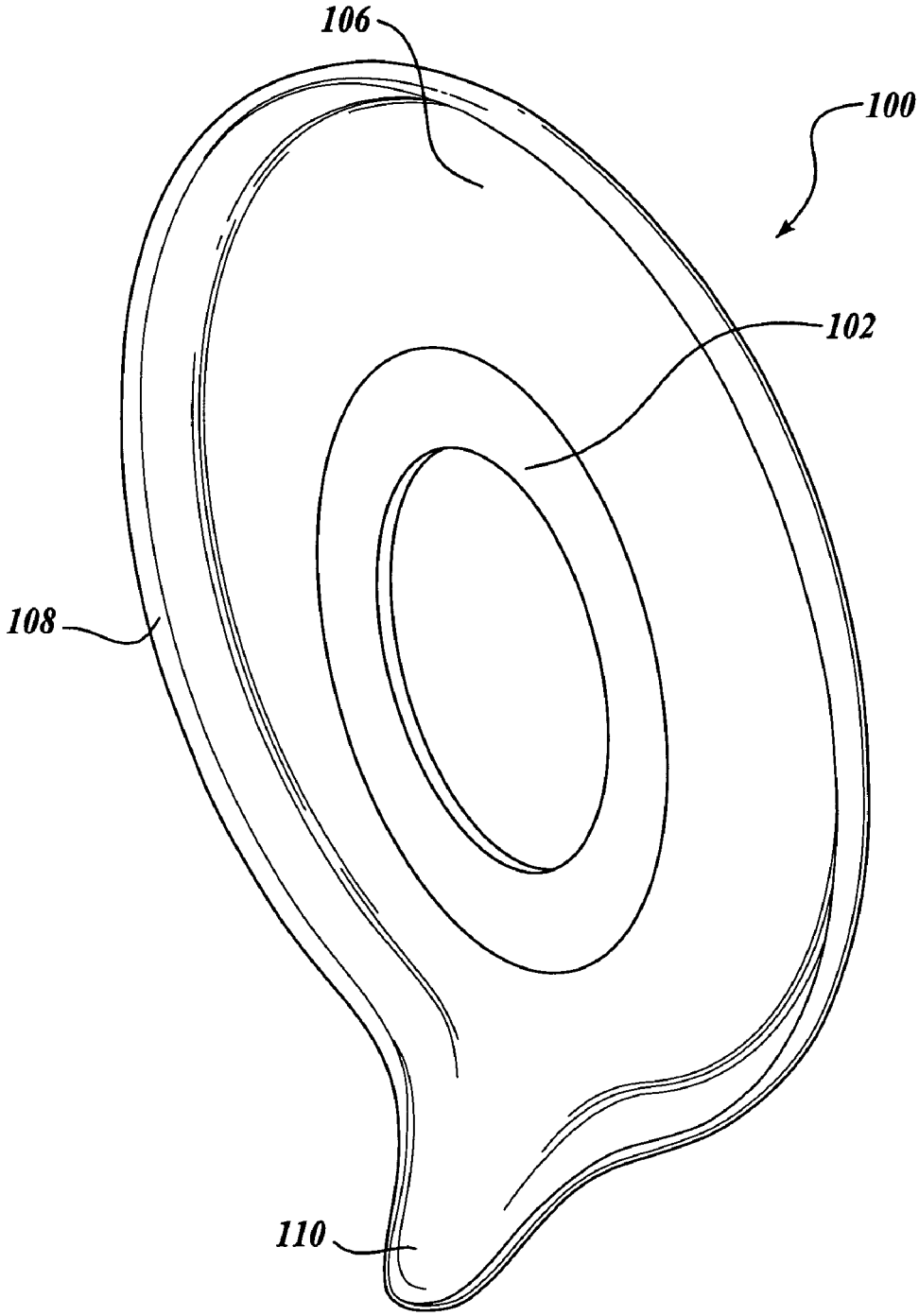
FIG. 5 is a perspective illustration of one embodiment of a fluid barrier apparatus with a flat seal 102 according to the present invention.

Particular aspects of using the invention are now described with reference to FIGS. 3 and 4. In actual use, one slides the hand 112 into the opening 104 of the seal 102 up to one's wrist or any other portion of the arm 114. It is to be appreciated that if clothing is worn, the seal 102 can be slid on top of the clothing. One can position the spout 110 to point in a generally downward direction, toward the ground, skewed at an angle, or away from the person, as shown in FIG. 4. As one raises one's arm above the shoulders, for example, the apparatus 100 is turned so that the basin 106 is ready to collect fluids running down the hand or arm, and divert them away from the person. Any fluids collected within the basin 106 are channeled to the drain 110 and emptied.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A fluid barrier apparatus, comprising:

a seal portion defining an opening for an arm portion;

a basin portion adjacent to the seal portion;

a lip portion adjacent to the basin portion; and a spout at the periphery of the basin portion, wherein the seal portion defines a seal surface to directly contact the whole perimeter of an arm portion to prevent the passage of fluids between the seal surface and the arm portion.

2. The apparatus of claim 1, wherein the spout portion slopes positively in relation to the basin portion.

3. The apparatus of claim 1, wherein the spout portion slopes negatively in relation to the basin portion.

4. The apparatus of claim 1, wherein the seal portion is substantially flat.

5. The apparatus of claim 1, wherein the seal portion comprises an elastomer.

6. The apparatus of claim 1, wherein the basin portion and the lip portion comprise a plastic.

7. The apparatus of claim 1, wherein the basin portion and the lip portion comprise a textile.

8. The apparatus of claim 1, wherein the seal portion further comprises a substantially cylindrical wall with sloping transition areas connected to the basin portion.

9. The apparatus of claim 1, wherein the seal portion and the basin portion are integral.

10. The apparatus of claim 1, wherein the basin portion and the lip portion are integral.

11. The apparatus of claim 1, wherein the seal portion comprises an elastomer, and the basin portion is made from a material dissimilar to the seal portion.

12. The apparatus of claim 1, wherein the basin portion is substantially flat.

13. The apparatus of claim 1, wherein the basin portion includes a cup-shaped area.

* * * * *